United States Patent [19]

Ayesh

[11] 4,074,374

[45] Feb. 21, 1978

[54] READING BED

[76] Inventor: Mark G. Ayesh, 1510 Lane, Apt. B6, Topeka, Kans. 66604

[21] Appl. No.: 733,243

[22] Filed: Oct. 18, 1976

[51] Int. Cl.[2] ..... A47C 21/00

[52] U.S. Cl. ..... 5/327 R

[58] Field of Search ..... 5/327 R, 327 B, 61, 5/86

[56] References Cited

U.S. PATENT DOCUMENTS

| | | | |
|---|---|---|---|
| 552,672 | 1/1896 | Souney et al. | 5/61 |
| 1,593,801 | 7/1926 | Koch | 5/327 B |
| 2,051,563 | 8/1936 | Mance | 5/327 B |
| 2,208,945 | 7/1940 | Miller | 5/327 R |
| 2,235,529 | 3/1941 | McCartney | 5/327 B |
| 3,266,061 | 8/1966 | Fuechsel | 5/86 |
| 3,608,103 | 9/1971 | Seid | 5/327 B |

*Primary Examiner*—Peter M. Caun

*Attorney, Agent, or Firm*—Edwin H. Crabtree; John H. Widdowson

[57] ABSTRACT

A reading bed for lying thereon in a prone position or sitting position. The bed supporting not only the lower portion of the body, but the chest, neck and head of the reader. In addition, the bed supports the arms and elbows of the reader. The bed by supporting the various parts of the body, allows the reader to greatly extend a time period for reading without discomfort to his body.

5 Claims, 6 Drawing Figures

READING BED

BACKGROUND OF THE INVENTION

This invention relates generally to a bed for supporting a body thereon, and more particularly, but not by way of limitation, to a reading bed for providing support of the body during extended periods of reading.

Heretofore, there have been various types of beds and in particular, hospital beds having a portion thereof that can be raised and lowered to aid the patient in recovery. Also, there are various types of designs of body supports and boards used for supporting different portions of the body. None of the prior art beds or body supports provide the novel features and advantages of the subject invention.

SUMMARY OF THE INVENTION

The reading bed provides a body support for a reader or student during extensive study. The bed is padded for comfort, but firm enough to thwart drowsiness or sleep. The bed allows the reader to greatly increase his concentration span thereby increasing the time period of reading without restlessness and discomfort associated with back pains, which are normal when reading at a desk or in a chair.

The reader may use the reading bed in a prone position while lying on his stomach, with his arms hanging naturally downward along the sides of the bed. In this position, the bed provides support for the lower portion of the body, the chest, the neck, chin and head of the reader. A head pillow mounted on the bed is shaped to spread pressure from the head evenly on the chin, throat and lower back. Also, the bed provides an adjustable arm support shelf for supporting the arms and elbows of the reader and provides stability for the elbows when turning pages in the book and underlining material in the book. Also, the shelf keeps the arms from falling asleep. The shelf is adjustable in heighth for readers having different arm lengths.

The bed provides support for the upper and lower portion of the body and the head, should the reader desire to lay on the bed in a prone position on his back.

Also, the bed provides a hinged head board which may be raised at an angle for converting the bed to a reading chair. The reading chair supports the lower portion of the body, the back, the neck, and the head of the reader.

The reading bed includes a padded, elongated horizontal body support mounted on a body support frame having vertical legs. An elongated "T" shaped padded head board is hingeably attached to one end of the body support. The head board is mounted on a head board frame with vertical legs. The body support provides support for the lower portion of the body, while the head board supports the chest and the back of the body. A head pillow is attached to one end of the head board for supporting the neck, chin, and head of the reader. The width of the head board is less than the width of the body support so that the arms of the reader hang naturally over the sides of the head board. Disposed below the head board and attached to the head board frame and body support frame is an adjustable, horizontal arm support shelf for supporting the arms and elbows of the reader.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
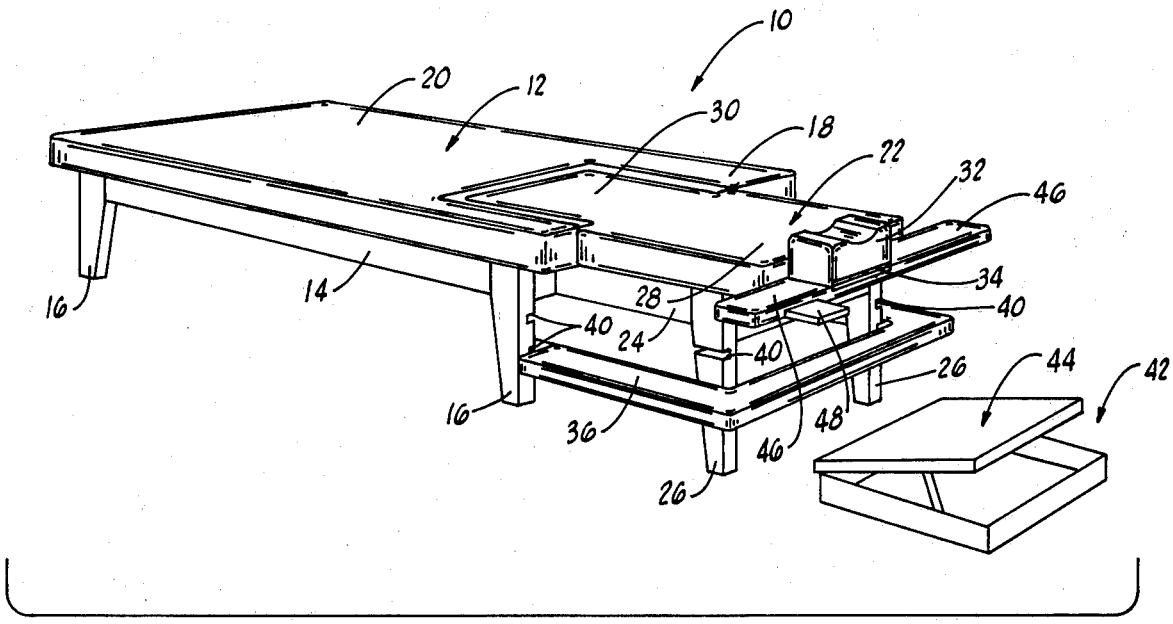
FIG. 1 is a perspective view of the reading bed with a book stand positioned in front of the bed.

In FIG. 1, the reading bed is designated by general reference numeral 10. The reading bed 10 includes a horizontal, padded elongated body support 12 mounted on a body support frame 14 with vertical legs 16 attached thereto. The body support 12 includes a first end portion 18 and a second end portion 20. The first end portion 18 is "U" shaped for receiving one end of a head board 22 therein.

The head board 22 is supported on a head board frame 24 with vertical legs 26. The head board 22 is padded and is "T" shaped with the upper portion designated by numeral 28 and the lower portion designated by numeral 30. A head pillow 32 is positioned in the center of the upper portion 28 of the head board 22, and is hingeably attached by a hinge 34. The lower portion 30 of the head board 22 is attached to the body support frame 14 by hinge 35 shown in FIG. 6.

Attached to the vertical legs 26 of the head board frame 24 and the vertical legs 16 of the body support frame 14, is a "U" shaped adjustable arm support shelf 36. The shelf 36 is attached to the legs 16 and 26 by inserting a portion thereof in horizontal grooves 40 in the sides of the legs. It should be noted that there are a plurality of horizontal grooves 40 along the length of the legs so that the shelf 36 can be adjusted for readers having various arm lengths.

Disposed in front of the head board 22 and positioned on a floor 42, is a book stand 44. The book stand 44 is used for supporting a book at the correct angle for viewing by the reader on the bed 10. As can be appreciated when using the book stand 44, the reader is in a prone position on his stomach on the bed 10. In this position the arms of the reader would hang naturally over the sides of the head board 22 with his arms and elbows supported on the shelf 36. The hands of the reader may rest on the front portion of the shelf 36 or may be positioned next to the book on the book stand 44 for underlining material in the book and turning the book pages. The shelf 36 provides support for the arms of the reader to prevent the arms from going to sleep over extended periods of reading.

In the alternative, the reader may rest his elbows on end portions 46 of the upper portion 28 of the "T" shaped head board 22, with his hands placed under the hinged head pillow 32.

Also seen in this view, is an angular shaped support 48 attached to one of the end portions 46. The support 48 may be used for attaching a reading light thereon.

Figure 2:
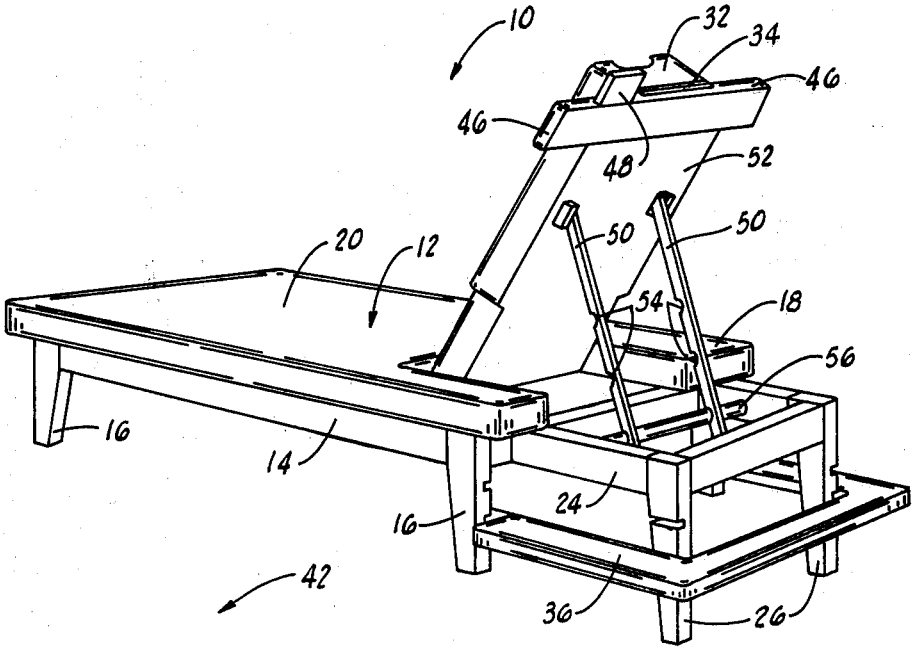
FIG. 2 is a perspective view of the reading bed with the head board raised at an angle.

In FIG. 2, the bed 10 is illustrated converted into a reading chair. This is accomplished by raising the head support 22 on the hinge 35 and at an angle to the head support frame 24. The head board 22 is supported at an angle by a pair of braces 50 pivotly attached to a bottom portion 52 of the head board 22. The braces 50 include a plurality of hooks 54 which are positioned on a lateral brace rod 56 horizontally mounted on the sides of the head board frame 24. By positioning the hooks 54 on the rod 56, the angle of the head board 22 can be adjusted as desired by the reader when using the bed 10 as a chair. In this position, the body support 12 provides support for the lower portion of the body and the head board 22 with pillow 32 provides support for the back, neck, and head of the body.

Figure 3:
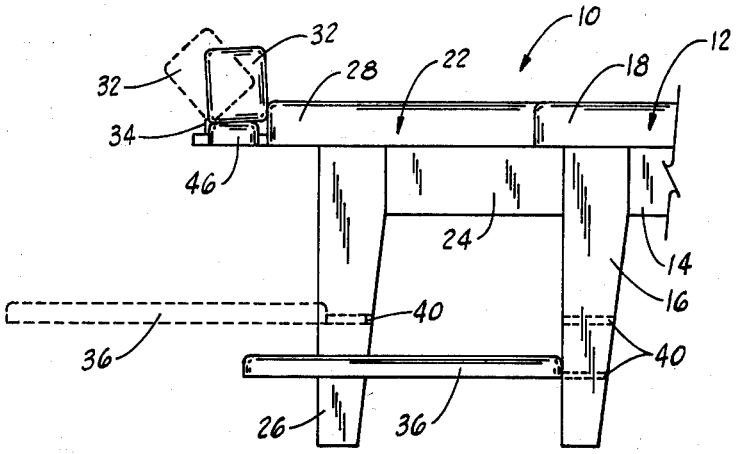
FIG. 3 is a partial side view of the head board and head board frame of the reading bed.

In FIG. 3, a partial side view of the head board 22 and head board frame 24 are shown. In this view, the adjustability of the arm support shelf 36 is illustrated. The shelf 36 is positioned in grooves 40 in a lower position for persons using the reading bed 10 having longer arms. Shown in dotted lines, is the shelf 36 in an alternate position for inserting into upper parallel grooves 40. This position would be used for people with shorter arm lengths.

Also seen in this view, is the hinged head pillow 32. The head pillow 32 is shown in dotted lines when raised on hinge 34. In this position, the reader while lying in a prone position on his stomach, can place his elbows on end portion 46 of the "T" shaped upper portion 28 of the head board 22. By raising the hinged head pillow 32, the reader can place his hands comfortably underneath the head pillow 32.

Figure 4:
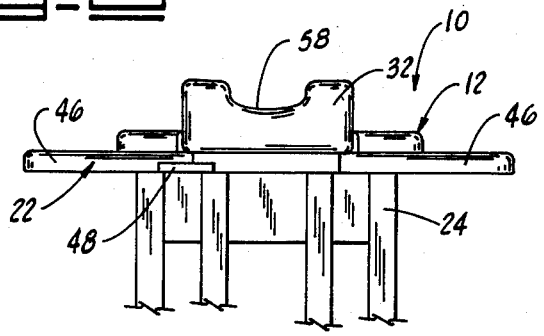
FIG. 4 is a front view of the head board and head pillow.

In FIG. 4, a concave portion 58 of the head pillow 32 is shown. The concave portion 58 provides a contoured pillow for resting and supporting the neck, chin, and head of the reader, and aids in spreading pressure from the head evenly on the chin, throat, and lower neck of the reader.

Figure 5:
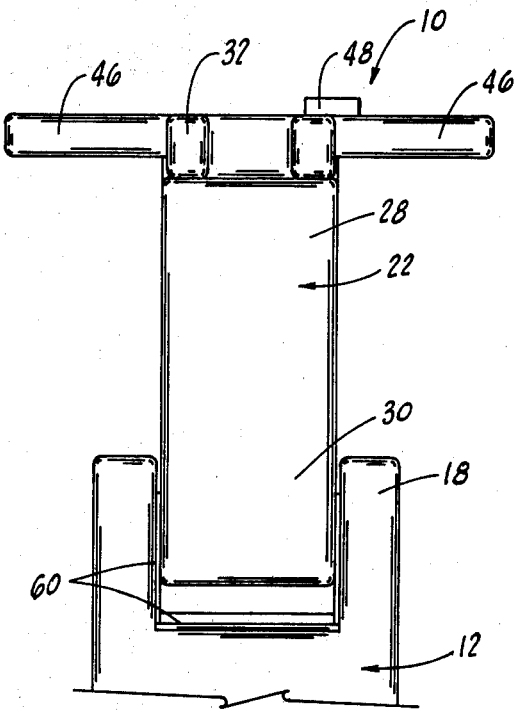
FIG. 5 is a partial top view of the head board attached to one end of the body support.

In FIG. 5, a partial top view of the first end portion 18 of the body support 12, is seen attached to the "T" shaped head board 22. In this view, the second end portion 30 of the head board 22 can be seen inserted inside a "U" shaped portion 60 of the first end portion 18 of the body support 12. The width of the head board 22 is less than the width of the body support 12. The difference in width allows the reader while lying in a prone position on his stomach, to hang his arms naturally over the sides of the head board 22 while the width of the head board is still great enough to comfortably support the chest of the reader.

Figure 6:
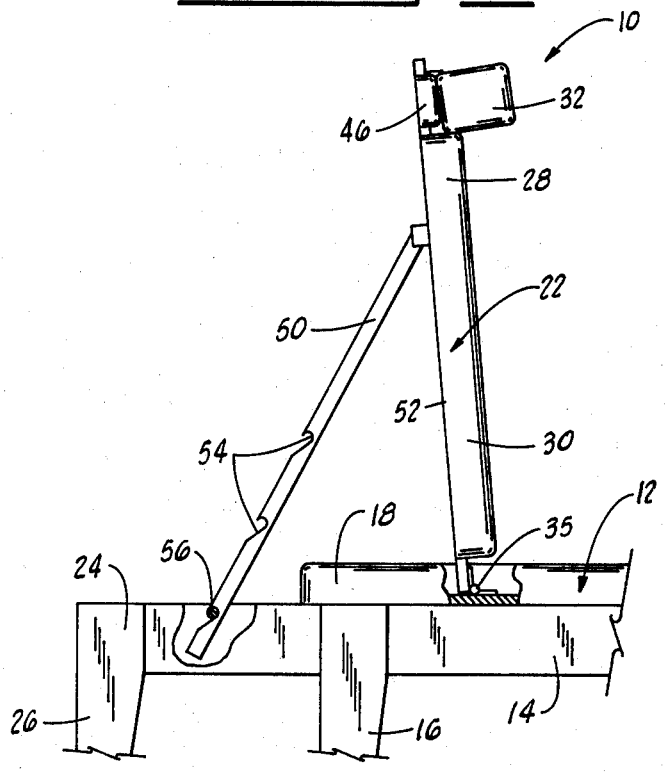
FIG. 6 is a partial side view of the reading bed with the head board raised at an angle from the horizontal.

In FIG. 6, a side view of the head board 22 is illustrated in a raised position so that the bed 10 can be used as a reading chair. A cut away portion of the body support 12 is shown to illustrate the hinge 35 used for attaching the second end portion 30 of the head board 22 to the body support frame 14. In this position, the head board 22 is seen approximately in a vertical position with the braces 50 supporting the head board 22 attached to the lateral brace rod 56.

The reading bed 10 in operation is designed for readers and students requiring a firm, yet comfortable, body support which will allow them to greatly extend their concentration span during extended periods of reading. This is accomplished by the bed 10 providing support of the various parts of the body. Also, the reader may lay in different positions on the bed 10 such as, a prone position on his back or stomach. Also, the head board 22, as described above, can be raised at various angles above the horizontal for providing a comfortable reading chair which supports not only the lower portion of the body, but also the back and head of the reader.

The length of the bed 10 is generally less than the overall length of the reader so that the feet of the reader may hang naturally off the end of the second end portion 20 of the body support 12. If the feet were supported on top of the body support 12, unnecessary pressure would be applied to the instep and toes of the feet.

Changes may be made in the construction and arrangement of the parts or elements of the embodiment as disclosed herein without departing from the spirit or scope of the invention as defined in the following claims.

I claim:

1. A reading bed for reading for extended periods, the bed comprising:

a padded elongated horizontal body support for supporting the lower portion of the body, said body support mounted on a body support frame having vertical legs attached thereto for supporting said body support thereon;

an elongated "T" shaped head board hingeably attached to one end of said body support for supporting the upper portion of the body, said head board mounted on a head board frame having vertical legs attached thereto for supporting said head board thereon;

a head pillow hingeably attached to said head board for supporting the head of the body;

a horizontal "U" shaped adjustable arm support shelf, said shelf attached to said head board frame, and one end of said body support frame for supporting the arms of the body; and a plurality of parallel horizontal grooves in said vertical legs of said body support frame and said head board frame for receiving a portion of said arm support shelf, by selecting corresponding parallel grooves in said legs, the height of said shelf is adjusted.

2. The bed as described in claim 1, wherein said head pillow includes a concave portion in the center thereof for receiving the chin and neck of the body thereon.

3. The bed as described in claim 1, wherein the end of said body support hingeably attached to said head board is "U" shaped for receiving a portion of the end of said head board therein, the width of said head board is less than the width of said body support, the arms of the body hanging naturally over the sides of said head board when the head board is in a horizontal position and the body is in a prone position on the bed.

4. A reading bed for reading for extended periods, the bed comprising:

a padded, elongated horizontal body support for supporting the lower portion of the body, said body support mounted on a body support frame having vertical legs attached thereto for supporting said body support thereon;

an elongated head board, one end of said head board hingeably attached to the end of said body support for raising said head board at an angle from the horizontal, the other end of said head board being "T" shaped, said head board mounted on a head board frame having vertical legs attached thereto for supporting said head board thereon;

a head pillow hingeably attached to the center of the "T" shaped end of said head board, said head pillow supporting the head of the body; and a horizontal "U" shaped adjustable arm support shelf, said support shelf slidably received in a plurality of parallel horizontal grooves in the vertical legs of said body support frame and said head board frame, by selecting corresponding parallel grooves in the legs, height of said shelf is adjusted below said head board.

5. The bed as described in claim 4, wherein the end of said body support hingeably attached to said head board is "U" shaped for receiving a portion of the end of said head board therein, the width of said head board is less than the width of said body support, the arms of the body hanging naturally over the sides of said head board when the head board is in a horizontal position and the body is in a prone position on the bed, the width of the "T" shaped end of said head board being greater than the width of said body support for receiving the elbows of the body when the body is in a prone position on the bed.

* * * * *